US005876505A

United States Patent [19]

Klyosov et al.

[11] Patent Number: 5,876,505

[45] Date of Patent: Mar. 2, 1999

[54] METHOD OF PRODUCING GLUCOSE FROM PAPERMAKING SLUDGE USING CONCENTRATED OR DILUTE ACID HYDROLYSIS

[75] Inventors: Anatole A. Klyosov, Newton; George P. Philippidis; Alan M. James, both of Boston; Yiannis A. Monovoukas, Waltham, all of Mass.

[73] Assignee: Thermo Fibergen, Inc., Bedford, Mass.

[21] Appl. No.: 6,631

[22] Filed: Jan. 13, 1998

[51] Int. Cl.[6] ..... C13K 1/02

[52] U.S. Cl. ..... 127/37

[58] Field of Search ..... 127/37

[56] References Cited

U.S. PATENT DOCUMENTS

| | | | |
|---|---|---|---|
| 2,734,836 | 2/1956 | Elian et al. | 127/37 |
| 3,532,594 | 10/1970 | Richter | 162/19 |
| 3,787,241 | 1/1974 | Eickemeyer | 127/1.37 |
| 4,160,695 | 7/1979 | Dietrichs et al. | 435/101 |
| 4,174,997 | 11/1979 | Richter | 162/19 |
| 4,201,596 | 5/1980 | Church et al. | 127/37 |
| 4,237,110 | 12/1980 | Forster et al. | 423/488 |
| 4,237,226 | 12/1980 | Grethlein | 435/99 |
| 4,242,455 | 12/1980 | Muller et al. | 435/162 |
| 4,266,981 | 5/1981 | Tsao et al. | 127/37 |
| 4,281,063 | 7/1981 | Tsao et al. | 435/99 |
| 4,316,747 | 2/1982 | Rugg et al. | 127/37 |
| 4,316,748 | 2/1982 | Rugg et al. | 127/37 |
| 4,349,668 | 9/1982 | Neuzil et al. | 536/127 |
| 4,384,897 | 5/1983 | Brink | 127/37 |
| 4,400,218 | 8/1983 | Kock et al. | 127/1 |
| 4,409,032 | 10/1983 | Paszner et al. | 127/37 |
| 4,427,453 | 1/1984 | Reitter | 127/1 |
| 4,427,584 | 1/1984 | LeGrand et al. | 260/124 R |
| 4,436,586 | 3/1984 | Elmore | 162/19 |
| 4,478,644 | 10/1984 | Berger et al. | 127/1 |
| 4,529,699 | 7/1985 | Gerez et al. | 435/165 |
| 4,556,430 | 12/1985 | Converse et al. | 127/36 |
| 4,556,432 | 12/1985 | Erckel et al. | 127/37 |
| 4,608,245 | 8/1986 | Gaddy et al. | 423/531 |
| 4,612,286 | 9/1986 | Sherman et al. | 435/157 |
| 4,645,541 | 2/1987 | DeLong | 127/37 |
| 4,645,658 | 2/1987 | Gaddy et al. | 423/488 |
| 4,650,689 | 3/1987 | Hedrick | 426/600 |
| 4,668,340 | 5/1987 | Sherman | 162/16 |
| 4,837,315 | 6/1989 | Kulprathipanja | 536/127 |
| 5,176,832 | 1/1993 | Dorta et al. | 210/635 |
| 5,188,673 | 2/1993 | Clausen et al. | 127/37 |
| 5,221,357 | 6/1993 | Brink | 127/43 |
| 5,395,455 | 3/1995 | Scott et al. | 127/37 |
| 5,486,068 | 1/1996 | Wilson | 405/129 |
| 5,536,325 | 7/1996 | Brink | 127/43 |
| 5,562,777 | 10/1996 | Farone et al. | 127/37 |
| 5,580,389 | 12/1996 | Farone et al. | 127/46.2 |
| 5,597,714 | 1/1997 | Farone et al. | 435/100 |

OTHER PUBLICATIONS

Anderson and Porteous, "A Review of Developments in the Acid Hydrolysis of Cellulosic Wastes," *IMechE, C88/85,* pp. 77–86 (1985) no month avail.

Fagan, Grethlein etal. ("Kinetics of the Acid Hydrolysis of Cellulose Found in Paper Refuse," *Env. Sci. Technol.* 5(6):545–547 (1971) no month avail.

Grethlein ("The Acid Hydrolysis of Refuse," *Biotechnol. Bioeng. Symp. No. 5,* pp. 303–318 (1975) no month avail.

Mackie et al., ("Effect of Sulphur Dioxide and Sulphuric Acid on Steam Explosion of Aspenwood," *J. Wood Chem. Technol.* 5(3):405–425 (1985)) no month avail.

Malester et al. ("Kinetics of Dilute Acid Hydrolysis of Cellulose Originating from Municipal Solid Wastes," *Ind. Eng. Chem. Res.* 31:1998–2003 (1992)) no month avail.

*Primary Examiner*—David Brunsman

*Attorney, Agent, or Firm*—Cesari and McKenna, LLP

[57] ABSTRACT

Glucose is obtained from papermaking sludge by first removing calcium carbonate from the sludge to produce a mixture substantially depleted of calcium and containing cellulose; and then hydrolyzing the calcium-depleted mixture using either a dilute or a strong acid. The glucose, as well as calcium salts removed from the sludge, may be isolated and used in numerous applications.

21 Claims, No Drawings

METHOD OF PRODUCING GLUCOSE FROM PAPERMAKING SLUDGE USING CONCENTRATED OR DILUTE ACID HYDROLYSIS

FIELD OF THE INVENTION

The present invention relates to utilization of renewable resources and industrial wastes, such as pulp and paper sludge, and in particular to a process of producing glucose from papermaking sludge materials.

BACKGROUND OF THE INVENTION

Pulp and paper sludge (a byproduct of primary pulping operations, recycle streams or waste paper pulping and the like) represents an environmental and disposal problem for manufacturers of pulp and paper. Generally, pulp and paper sludge is unsuitable for paper making, although it generally contains the same components—cellulose, lignin, hemicellulose, calcium carbonate, clay, and other inorganic components—as those present in the paper pulp itself.

Paper sludge has traditionally been disposed of by landfilling, composting, incorporation into cement, and incineration. The latter option, in turn, creates another problem, namely, disposal of the resulting ash, which often makes up to 50% (and some times as much as 80% or higher) of the volume of the sludge itself.

The principal components of ash are calcium carbonate—in the form of precipitated calcium carbonate (PCC) or ground calcium carbonate (GCC)—that typically constitutes 20% and up to 75% of dry sludge content, and clay. These two minerals are typically loaded into paper as a coating and filler to improve the mechanical characteristics as well as the appearance of paper. This makes papermaking sludge, particularly mixed office paper sludge, consisting of two major components, that is fiber and minerals, finely mixed with each other.

A typical recycling mill processes 600 tons of wastepaper per day, yielding 450 tons of pulp and producing 150 tons of papermaking sludge. The 228 mills currently under operation in North America produce 9 million tons of pulp residue, approximately 5 million tons of which is cellulose. The 154 European pulp and paper mills produce about 8 million tons of pulp residue, approximately 4 million tons of which is cellulose. The conversion of such waste material into glucose as alternate source of fuels, chemicals, and other useful products by acid and/or enzymatic hydrolysis of cellulose has long been desired. However, the mineral components of papermaking sludge dramatically decrease the efficiency of enzymatic hydrolysis of the cellulose component, making it technically unrealistic and economically prohibitive. Likewise, the high content of calcium carbonate in typical papermaking sludge renders the use of acid for cellulose hydrolysis practically impossible, because calcium carbonate reacts with and neutralizes the acid. For these reasons, industry has failed to develop a feasible approach to producing glucose from papermaking sludge using acid hydrolysis; and as a result, the cellulose component of papermaking sludge is generally largely or totally wasted. At best, the prior art describes utilization of paper sludge for production of low-end products of limited market value, without their chemical conversion into value-added products.

The carbohydrate content of plant materials consists of cellulose and hemicellulose, both polysaccharides. Chemical pulping of plant materials largely removes hemicellulose, which is much more susceptible to acid treatment and depolymerizes easily compared to cellulose. Hence, acid hydrolyses of conventional, chemically intact "biomass," on the one hand, and papermaking sludge, on the other, often differ substantially: the conventional and generally milder hydrolysis of biomass typically aims to produce sugars, most of which originate from hemicellulose (e.g., U.S. Pat. Nos. 2,734,836, 4,436,586, 4,511,433, 4,612,286, 4,668,340), while papermaking sludge typically contains much less hemicellulose; accordingly, the hydrolysis conditions are generally more stringent in order to break down recalcitrant cellulose into glucose.

Acid hydrolysis of cellulose and hemicellulose has been extensively studied since the beginning of this century, particularly in connection with sugar production and subsequent fermentation to ethanol; see Anderson and Porteous, "A Review of Developments in the Acid Hydrolysis of Cellulosic Wastes," *IMechE, C*88/85, pp. 77–86 (1985). Typical cellulosic-hemicellulosic materials for acid hydrolysis have included particulate wood in the form of chips, sawdust and shavings, and other plant materials and agricultural wastes (such as straw, bagasse, etc.), provided that the polysaccharides in those materials have appropriate chemical reactivity for acid hydrolysis. For example, Fagan, Grethlein et al. ("Kinetics of the Acid Hydrolysis of Cellulose Found in Paper Refuse," *Env. Sci. Technol.* 5(6):545–547 (1971)) detail processing of ball milled Kraft paper and municipal refuse (with no other components interfering with the hydrolysis) in the 180° C.–240° C. temperature range with sulfuric acid concentrations of 0.2%, 0.5%, and 1.0%, and on a scale of 0.5 gram with respect to paper amount. They showed that at 230° C. with 1.0% acid, 52% of the cellulose could be converted to (unspecified) sugars; with 0.5% acid, the sugar yield was 39%. Subsequently, Grethlein ("The Acid Hydrolysis of Refuse," *Biotechnol. Bioeng. Symp. No.* 5, pp. 303–318 (1975)) disclosed that the glucose concentration in those experiments was only about 2 g/L (due to the limit of 1% slurry in the reactor). According to Mackie et al. ("Effect of Sulphur Dioxide and Sulphuric Acid on Steam Explosion of Aspenwood," *J. Wood Chem. Technol.* 5(3):405–425 (1985)), the action of 0.58% (w/w) sulfuric acid on aspen wood chips for 80 sec at 200° C. liberated 16.4% pentosans (from the initial 18.3%), only 12% of which (i.e., 2.0% overall) was glucose. 70.5% of the initial wood was recovered from the reaction mixture as a solid residue (30.7% of that was lignin). Malester et al. ("Kinetics of Dilute Acid Hydrolysis of Cellulose Originating from Municipal Solid Wastes," *Ind. Eng. Chem. Res.* 31:1998–2003 (1992)) showed that for dilute-acid hydrolysis of cellulose derived from municipal solid wastes, the best conditions were the most severe ones among those tested: pH 0.34 and temperature of 240° C. Under these conditions, a glucose yield of 54.3% was achieved at a reaction time of 4.6 sec. The actual acid concentrations used and the concentration of glucose obtained were not reported.

Sulfuric acid has commonly been used as an active agent, though other acids, such as hydrochloric (e.g., U.S. Pat. Nos. 4,237,110, 4,645,658, 4,650,689), phosphoric (e.g., U.S. Pat. Nos. 4,409,032, 5,486,068), nitric (e.g., U.S. Pat. Nos. 5,221,357, 5,536,325), trifluoroacetic (e.g., U.S. Pat. No. 4,400,218), and also gaseous hydrogen fluoride (U.S. Pat. No. 4,556,432), sulfur dioxide (U.S. Pat. No. 4,278,471), and sulfur trioxide (U.S. Pat. No. 4,427,584) have also been used.

Once again, materials that contain along with cellulose some other components (such as calcium carbonate in papermaking sludge) capable of effectively neutralizing an acid cannot be considered appropriate substrates for acid hydrolysis. As a result, known techniques of acid hydrolysis of cellulose (see, e.g., U.S. Pat. Nos. 3,532,594, 3,787,241, 4,160,695, 4,174,997, 4,201,596, 4,237,226, 4,242,455, 4,266,981, 4,281,063, 4,316,747, 4,316,748, 4,384,897, 4,427,453, 4,478,644, 4,529,699, 4,556,430, 4,615,742, 4,645,541, 5,486,068, 5,536,325, 5,562,777, 5,580,389, 5,597,714) have not been applied to hydrolyze cellulose in papermaking sludge.

DESCRIPTION OF THE INVENTION

Brief Summary of the Invention

The present invention facilitates production of glucose by either concentrated or dilute acid hydrolysis of the cellulose component of papermaking sludge (pressed/wet or dried). Generally, the invention is applied to cellulose obtained from sludge (e.g., in accordance with copending application Ser. No. 08/877,548, filed on Jun. 17, 1997, the entire disclosure of which is hereby incorporated by reference), which cellulose may or may not be mixed with clay, although the approach described herein is applicable to many variants of cellulose or cellulose-clay composites regardless of their origin.

The invention generally involves a two-step procedure: (i) calcium solubilization by combining the pressed or dried sludge with a dilute acid, following which the solid content is separated from the liquid content (to yield a liquid fraction comprising a solids-free solution of the calcium salt and a solid fraction mainly comprising cellulose and clay), and (ii) acid-mediated hydrolysis by combining the pressed or dried solid residue with a dilute or concentrated acid, following which the mixture is either heated in an autoclave up to 180°–240° C. (in the case of dilute acid), the optimal temperature depending on the extent of heating (ranging, for example, from 180° C. for 40 min to 240° C. for 10 sec) or treated with acid under atmospheric conditions and then heated only to 80°–100° C. in the presence of water (in the case of concentrated acid). With a sufficiently high solid sludge-residue content in the hydrolysis reactor, such as up to 25% (with dilute acid) and up to 50% (with concentrated acid), the liquid obtained will contain glucose in concentrations up to 50–60 g/L (with dilute acid) or up to 90–180 g/L (with concentrated acid). The separation of the liquid from the solid residue (if any) is preferably carried out using belt presses, screw presses, centrifuges, filters, or a combination. The solids obtained can be further washed with water in order to increase the amount of recovered glucose.

Detailed Description of the Preferred Embodiments

Papermaking sludge typically contains a rather high amount of $CaCO_3$ (20%–50% or more of the solids content). In the presence of many acids, $CaCO_3$ is solubilized as a result of conversion into the acid-anion salt in the reaction mixture. Also, $CaCO_3$ in the sludge is typically accompanied by aluminosilicates (clay) and other minerals (as pigments, fillers, etc.), such as those based on magnesium, potassium and others. These can be partially extracted with acids as well. Obviously, the extent of acid extraction/solubilization of the inorganic components greatly depends on the conditions of the sludge treatment with acids, nature of the acid, acid concentration, and contact time with the acid in particular.

The first step in the method of the invention (i.e., calcium solubilization) can be practiced in accordance with the '548 application. Removal of calcium from papermaking sludge facilitates subsequent acid-mediated hydrolysis of its cellulose component to produce glucose. As described in the '548 application, pressed or dried sludge is combined with a dilute acid, following which the solid content (mainly cellulose and clay) is separated from the liquid content (a solution of calcium and other salts). The separation of the liquid from the solid residue may be carried out using belt presses, screw presses, centrifuges, filters, or a combination. With regard to sludge, this may be mixed with a solution of an inorganic or organic acid—in concentrations generally ranging from 0.1% to 55% by weight, and most preferably 3% to 16%, the optimal concentration depending on process conditions (in particular, calcium carbonate content in the processed papermaking sludge). In preferred embodiments, the mixture is combined with 2% to 6% HCl; 2% to 8% $HNO_3$; or 2% to 16% acetic acid. Generally, the amount of acid added into the reaction mixture is 0.8 to 5.0 times the stoichiometric calcium carbonate content in the mixture, preferably 0.8 to 2.0 times the stoichiometric content, and most preferably 1.0 to 1.2 times the stoichiometric content. The acid-containing mixture is incubated (with agitation, if desired, to shorten the reaction time) to solubilize calcium carbonate and other minerals, following which the liquid phase is isolated, and the cellulose component (with or without insoluble minerals) recovered. Completion of calcium solubilization can be verified by determination of the calcium concentration or content in the bulk solution. The liquid phase, containing calcium salts, can be utilized in accordance with the '548 application.

After completion of calcium solubilization and recovery of calcium carbonate-free cellulose fiber, or a mixture of fiber and clay, glucose can be obtained using either dilute or strong acid hydrolysis. In this step, the hydrolysis is preferably carried out with sulfuric acid, in the range of 0.5% to 5% w/v (for a dilute acid), or 50% to 98% w/w (for a concentrated acid). In one embodiment of the invention, a glucose solution is obtained from papermaking sludge residue using dilute sulfuric acid, based on, for example, the general procedure described in U.S. Pat. Nos. 4,529,699 and 4,645,541. In a second embodiment, glucose is obtained using concentrated sulfuric acid, based on, for example, the general procedure described in U.S. Pat. Nos. 5,188,673, 5,486,068, 5,562,777, and 5,597,714. The '699, '541, '673, '068, '777, and '714 patents are hereby incorporated by reference in their entireties.

Dilute-acid hydrolysis of cellulose requires high temperatures (180° C.–240° C.) and, therefore, high-pressure reactors, while strong-acid hydrolysis runs at atmospheric pressure and milder temperatures (60° C.–100° C.). Strong-acid hydrolysis requires regeneration of spent acid to make the process economically acceptable. Dilute-acid hydrolysis at high temperature produces high glucose concentrations within seconds, while strong-acid hydrolysis requires about an hour to reach equally high (or higher) glucose concentrations. However, high-temperature glucose formation is accompanied by the generation of sugar decomposition products, often inhibitory in relation to follow-up fermentation processes, while strong-acid hydrolysis generally yields higher degree of conversion of cellulose to glucose. For example, glucose solutions derived in accordance herewith can be fermented by appropriate microorganisms, such as *Anaerobiospirillum succiniproducens*, to produce chemical, biochemical and pharmaceutical compounds. As a result, a rather complex pattern of factors should be considered in order to choose a principal mode of cellulose hydrolysis, that is dilute or strong acid to use.

A. Dilute-acid hydrolysis

In preferred embodiments, cellulose residue (with or without clay) after solubilization of calcium salts in papermaking sludge (calcium solubilization), or any other $CaCO_3$-free papermaking sludge is mixed with a solution of dilute mineral acid, preferably sulfuric acid, generally in concentration of 0.5% to 5% by weight per volume, such as 5 g/L to 50 g/L, preferably 0.7% to 2% w/v, and most preferably 0.8% to 1.5% w/v. Generally, the ratio of solids (dry weight) to liquid in the reactor chamber is 1:10 to 1:2 by weight, preferably 1:5 to 1:3 by weight, and most preferably 1:4 by weight. The mixture is heated to temperature 180°–240° C., preferably 180°–210° C., and most preferably 190°–200° C. for 10 sec to 40 min, preferably 2 to 15 min, and most preferably 3 to 6 min. The mixture is cooled to ambient temperature, pressed, and liquid, containing glucose and other sugars, is separated.

In another preferred embodiments, said mixture of papermaking sludge residue with a mineral acid in said concentrations is placed in a reactor or autoclave, and treated with saturated steam at temperature 220° C. to 240° C. The mixture is cooled to ambient temperature, pressed, and liquid, Generally, these preferred embodiments result in up to 30–50 g/L of glucose solutions (that depends on ash content and moisture content in the sludge, among other factors), and degree of cellulose conversion to glucose up to 20–30%. The glucose solution is appropriate for fermentation using microbial organisms such as *Anaerobiospirillum succiniproducens*.

B. Strong-acid hydrolysis

In preferred embodiments, cellulose residue (with or without clay) after solubilization of calcium salts in papermaking sludge (calcium solubilization), or any other $CaCO_3$-free papermaking sludge is mixed with a solution of concentrated sulfuric acid, generally in concentration of 50% to 98% by weight, preferably 70% to 96% by weight, and most preferably 80% to 96% by weight. Generally, the ratio of solids (dry weight) to liquid in the reaction mixture is 1:0.7 to 1:7 by weight, preferably 1:1 to 1:2 by weight, and most preferably 1:1.5 by weight. Moisture content in the paper sludge residue generally is 0 to 60%, preferably 5% to 50%, and most preferably 5% to 40%. The mixture is incubated under cooling conditions (particularly when 96% sulfuric acid and/or dry sludge residue is used), preferably for 10 to 30 min, and more preferably for 15 to 20 min. The acid is then diluted with water to a concentration of 20% to 45% (preferably about 30%), and heated at 90° C. to 100° C. for 30 to 60 min (preferably about 40 min). Finally, the mixture is cooled to ambient temperature and pressed, and a liquid fraction containing glucose and other sugars in about 20% to 45% sulfuric acid, is collected. Separation of glucose can be accomplished (a) by chromatography on ion-exchange resins as described in U.S. Pat. Nos. 4,349,668, 4,608,245, 4,837,315, 5,188,673, 5,176,832, followed by regeneration, concentration, and recycling of sulfuric acid as described in U.S. Pat. No. 5,580,389; (b) by neutralization of sulfuric acid, e.g. with calcium, barium, or other appropriate metal carbonates, hydroxides, or other bases, as described in U.S. Pat. Nos. 4,384,897, 4,278,471; (c) selective extraction of glucose into a water-immisible solvent, such as long-chain alcohols (as described in U.S. Pat. Nos. 4,237,110 and 4,608,245), or acetophenone (as disclosed in U.S. Pat. No. 4,645,658, which details separation of glucose and hydrochloric acid), or propionaldehyde (as set forth herein), or other appropriate solvents.

Generally, these preferred embodiments result in solutions of up to 80–150 g/L of glucose (the precise concentration depending on ash content and moisture content in the sludge, among other factors), and a conversion ratio of cellulose into glucose as high as 60–80%.

The sugar (predominantly glucose) obtained in the liquid can be employed in solution, in a concentrated form, or in the solid state (e.g., by evaporation of the water phase) as a separate product, or can be fermented using appropriate microorganisms (such as *Anaerobiospirillum succiniproducens*) into chemicals, biochemicals and pharmaceuticals. Using the approach of the present invention, it is possible to obtain solutions of glucose from a number of papermaking sludge materials.

C. Experimental Procedures

1. Determination of calcium

TAPPI procedure T 247 cm-83 (Classical Method—1983) was used for calcium determination in sludge and pulp. The procedure is based on EDTA titration of $HNO_3$-soluble calcium in ashed sludge and pulp. EDTA forms a highly colored water-soluble complex with calcium, while other metal ions present in solution are masked with triethanolamine. The ash was placed in 10 mL of Milli-Q and 3 mL of 5M nitric acid (325 mL of concentrated nitric acid diluted to 1 L with water) was added. The mixture was heated for 5–10 min on a steam bath and transferred into a 300-mL flask. The volume was adjusted to 100 mL, 5 mL of 8M KOH solution was added, and the flask was shaken occasionally for 5 min, and 5 mL of triethanolamine (diluted 10 times), and then 2 mL of hydroxylamine hydrochloride solution (2 g/100 mL) were added, along with 100 mg of cal-red indicator. The mixture was then titrated with 0.02M EDTA solution to a color change from red-wine to blue. The calcium content (in %) was calculated as EDTA(mL)×0.08016/g of dry weight ash.

2. Determination of glucose

The YSI Model 2700 Select Biochemistry Analyzer was used for glucose determination in solutions with approximately neutral pH. When acid hydrolyzates were used, the pH was adjusted with solid ammonium carbonate to a level between 6 and 8.

Alternatively, the glucose concentration was determined using the glucose oxidase-peroxidase method. Glucose oxidase catalyzes the conversion of D-glucose to D-gluconic acid and hydrogen peroxide, while peroxidase catalyzes reaction of the formed hydrogen peroxide with o-dianisidine, resulting in intensely colored products. In this way, the optical density of these products (within a certain concentration and optical density (OD) range determined by a calibration with standard glucose solutions) is directly related to the initial glucose concentration in the analyzed solution.

Glucose oxidase-peroxidase (GOP) reagent was prepared by mixing 50 mL of 0.1M phosphate buffer solution, pH 7.0, with 30 $\mu$L of peroxidase stock solution and 10–40 mg of glucose oxidase powder (or, alternatively, with 10–50 $\mu$L of glucose oxidase suspension). Both glucose oxidase powder and suspension are readily available. Peroxidase stock solution is prepared by adding a few mg of peroxidase powder to several mL of the above buffer, such that the OD at 403 nm is equal to 0.25. The OD value can be adjusted by addition of more peroxidase or by dilution with the buffer. Peroxidase stock solution can be stored in a refrigerator for weeks. The GOP reagent should be calibrated with standard glucose solutions (e.g., between 0.8 mg/mL and 4 mg/mL in water) the same day it is used.

o-Dianisidine stock solution was prepared by dissolving 6 mg of o-dianisidine in 10 mL of ethanol.

To determine glucose concentration, 1 mL of GOP solution was placed into a spectrophotometric cuvette. 20 $\mu$L of the tested glucose solution were added, mixed carefully, and allowed to react for 4 min. Then 100 μL of o-dianisidine stock solution were added, mixed quickly, and the OD was read at 460 nm against time for 3 min (reading points every 15 sec or using a continuous chart recorder).

When glucose solutions in strong sulfuric acid were tested, they were diluted 25-fold in the above buffer (pH 7.0), and then tested directly with GOP-dianisidine solution, as described above. No neutralization was needed.

3. Determination of cellulose

Cellulose content was evaluated in accordance with TAPPI procedure T 203 om-93.

4. Moisture determination

In papermaking sludge and other solid materials, moisture was quantified by heating a sample at 105° C.—until a constant weight was attained—using the Mettler Infrared Moisture Analyzer, or a programmable oven. Ash content was determined by combustion of the material overnight in a furnace at 525° C., and is always given per dry weight.

Solubilization of calcium is further described in the following Examples 1–4; dilute-acid hydrolysis of cellulose in calcium carbonate-free papermaking sludge residues is described in Examples 5–25; and strong-acid hydrolysis of cellulose in $CaCO_3$-free papermaking sludge residues is described in Examples 26–46.

The following Examples 1–4, performed generally in accordance with the teachings of the '548 application, detail decalcification of papermaking sludge for subsequent acid hydrolysis.

D. Solubilization of Calcium

EXAMPLE 1

This example describes removal of calcium carbonate (in the form of calcium chloride) from mixed office sludge by diluted hydrochloric acid, in a proportion of 1.1 times the stoichiometric calcium carbonate content in the sludge. The initial sludge material had a moisture content of 50.2%, an ash content of 37.0% (dry matter), and an elemental calcium content of 8.6%, representing a calcium carbonate content of 21.5% in the whole dried sludge.

The solubilization was performed as follows. 1,800 mL (2,124 g) of 37.2% hydrochloric acid was diluted to 18.22 L with water, and the resulting 3.7% (v/v) or 4.3% (w/w) HCl was added to 9.11 kg of the wet sludge (taking into account water content in the sludge, the final concentration of HCl in the liquid was 2.9% v/v, or 3.4% w/w). That amount of hydrochloric acid was 11% higher than the stoichiometric amount needed for complete solubilization of the calcium carbonate present in the sludge. The mixture was incubated for 1 hr at room temperature with moderate agitation. A supernatant was then decanted, the solid residue pressed, and 14 L of liquid collected. The pH of the liquid was 1.7. The liquid contained 5.5% dissolved solids, as shown by evaporation of a 5-mL sample at 105° C. The elemental calcium content in the liquid extract was 14.2 mg/mL, translating into 3.9% $CaCl_2$.

The pressed sludge residue contained 65% moisture. The pH of the 20% suspension of the solid was 3.2. The air-dried material contained 37% moisture, and had a pH of 3.5. The calcium content in the unwashed solids was 3.5% (per dry weight), consisting mainly of $CaCl_2$, since the calcium content in the solids following washing with water and drying at 105° C. was 0.2%. Hence, the upper limit of $CaCO_3$ in the post-HCl sludge residue, was 0.5% (per dry weight).

The post-HCl sludge residue (unwashed, $CaCl_2$-impregnated) contained 25.1% ash. The same post-HCl material, but washed with water, contained 21.2% ash. These figures can be compared with 37.0% ash in the initial sludge; the difference is due to loss of $CaCO_3$ in the post-HCl sludge residue. The calcium content in ash, obtained by combustion of washed post-HCl sludge residue, was 1.1%, a figure that agreed well with the above data.

EXAMPLE 2

The procedure of Example 1 was repeated, but with the difference that the amount of hydrochloric acid added to the sludge was 1.3 times the stoichiometric calcium carbonate content in the sludge. 2,523 mL (2,977 g) of 37.2% HCl were diluted to 24 L with water, and the resulting 3.9% (v/v) or 4.5% (w/w) HCl was added to 11 kg of the wet sludge (taking into account water content in the sludge, the final concentration of HCl in the liquid was 3.2% v/v, or 3.7% w/w). 22 L of extract were collected, and the pH of the liquid was 1.1. The liquid contained 6.4% solids (dried at 105° C.). The elemental calcium content in the liquid extract was 13.8 mg/mL, translating into 3.8% $CaCl_2$.

The pressed sludge residue contained 63% moisture. The pH of the 20% suspension of the solid was 4.2. The calcium content in the unwashed and washed solids was 3.8% and 1.4%, respectively (per dry weight). Hence, the upper limit of $CaCO_3$ in the post-HCl sludge residue was 3.5% (per dry weight).

The post-HCl sludge residue (unwashed, $CaCl_2$-impregnated) contained 29.4% ash. The same post-HCl material, but washed with water, contained 24.1% ash (compared with 37.0% ash in the initial sludge).

EXAMPLE 3

The procedure of Example 1 was repeated, but with a different sample of mixed office sludge. The sludge material had a moisture content of 60.4%. an ash content of 53% (per dry matter), and an elemental calcium content of 7.6%, representing a calcium carbonate content of 19% in the whole dried sludge.

1,400 mL (1,652 g) of 37.4% hydrochloric acid were diluted to 10 L with water, and the resulting 5.2% (v/v) or 6.2% (w/w) HCl was added to 10.0 kg of the wet sludge (taking into account water content in the sludge, the final concentration of HCl in the liquid was 3.0% v/v, or 3.5% w/w). That amount of hydrochloric acid was 13% higher than the stoichiometric amount needed for complete solubilization of the calcium carbonate present in the sludge. The mixture was incubated for 4 hrs at room temperature with moderate agitation. A supernatant was then decanted, the solid residue pressed, and the liquid collected. The pH of the liquid was 2.3. The liquid contained 6.3% dissolved solids, as shown by evaporation of a 5-mL sample at 105° C. The elemental calcium content in the liquid extract was 21.5 mg/mL. translating into 6.0% $CaCl_2$.

The pressed and air-dried sludge residue contained 39% moisture, and the pH of the 20% suspension was 2.4. The calcium content in the unwashed and washed solids was 1.6% and 0.5%, respectively (per dry weight). Hence, the upper limit of $CaCO_3$ in the post-HCl sludge residue was 1.25% (per dry weight).

The post-HCl sludge residue, unwashed ($CaCl_2$-impregnated) and washed with water, both contained 46% ash, compared with 53% ash in the initial sludge.

Both unwashed and washed sludge residues were dried overnight at 105° C. The 10% suspension of the dried materials in water had pH levels of 6.3 and 6.0, respectively.

EXAMPLE 4

The procedure of Example 3 was repeated, but with the difference that the amount of the sludge treated with the acid was larger (80.2 kg of wet sludge, 60.0% of moisture content). 10,800 mL (12.744 g) of 37.4% HCl was diluted to 100 L with water, and the resulting 4.0% (v/v) or 4.8% (w/w) HCl was added to 80.2 kg of the wet sludge (taking into account water content in the sludge, the final concentration of HCl in the liquid was 2.7% v/v, or 3.2% w/w). The extract was collected, and the pH of the liquid was 2.4. The liquid contained 5.5% solids (dried at 105° C.). The elemental calcium content in the solids was 29.2%, translating into 81% $CaCl_2$ content in the total solids extracted from the sludge. The elemental calcium content in the liquid extract was 16.9 mg/mL, translating into 4.7% $CaCl_2$, or 85% of $CaCl_2$ content in the total solids dissolved in the extract.

The pressed and air-dried sludge residue contained 47% moisture. The pH of the 20% suspension of the solid was 2.3. The calcium content in the unwashed and washed solids was 2.6% and 1.4%, respectively (per dry weight). Hence, the upper limit of $CaCO_3$ in the post-HCl sludge residue was 3.5% (per dry weight).

The post-HCl sludge residue (unwashed, $CaCl_2$-impregnated) contained 45.6% ash. The same post-HCl material, but washed with water, contained 44.8% ash (compared with 53% ash in the initial sludge).

E. Dilute Acid Cellulose Hydrolysis

EXAMPLE 5

This example describes 1% (w/v) sulfuric acid hydrolysis of cellulose component in mixed office waste papermaking sludge, decalcified as described in EXAMPLE 1. The sludge residue was washed (to remove salts, mainly calcium chloride) and air dried, and had a moisture content of 20%, an ash content of 21.2%, and elemental calcium content of 0.2%.

The acid treatment was performed as follows. 50 g of the sludge residue were mixed with 200 mL of 1% sulfuric acid (w/v) and placed into an autoclave (Zipperclave, Autoclave Engineers, Erie, Pa.). The temperature was raised from 150° C. to 210° C. for 12 min, then for 30 min allowed to fluctuate between 210° C., 190° C. and 207° C. (with 18 min above 200° C.), cooled down to 129° C. for 13 min, and finally cooled down to ambient temperature.

The solid residue from the reactor was removed, washed with water, and dried at 105° C. Its dry weight was 31.2 g (down from the initial 40 g of dry matter). This indicates that 8.8 g, i.e., 22% of the initial sludge, or 31% of the initial cellulose content (28 g, estimated), was solubilized.

110 mL of liquid were recovered from the reaction system; it had a pH of 1.75 and a glucose concentration of 10.7 g/L. The total amount of glucose formed in 215 mL of solution (including water in the wet sludge) was 2.3 g. Stoichiometrically, 2.07 g of cellulose was converted to that amount of glucose, translating into a 7.4% yield of glucose relative to the initial cellulose.

EXAMPLE 6

The procedure of Example 5 was repeated, but with the difference that washed and air-dried sludge residue having a higher moisture content (47%) was used, and the temperature profile of the reaction was as follows. The temperature was raised from 119° C. to 209° C. for 21 min, then for 17 min allowed to fluctuate between 209° C., 196° C. 208° C. (with a total of 16 min above 200° C.), cooled down to 114° C. for 33 min, and finally cooled down to ambient temperature.

The solid residue from the reactor was removed washed with water, and dried at 105° C. Its dry weight was 19.1 , (down from the initial 26.5 g of dry matter). This indicates that 7.4 g, i.e., 28% of the initial sludge, or 40% of the initial cellulose content (18.6 g, estimated), was solubilized.

150 mL of liquid were recovered from the reaction system; it had a pH of 1.71 and a glucose concentration of 8.4 g/L. The total amount of glucose formed in 223.5 mL of solution (including water in the wet sludge) was 1.9 g. Stoichiometrically, 1.69 g of cellulose was converted to that amount of glucose, translating into a 9.1% yield of glucose relative to the initial cellulose.

EXAMPLE 7

The procedure of Examples 5 and 6 was repeated, but with the difference that the unwashed (salt-containing) air-dried sludge residue was used, with a moisture content of 32%, and the reaction was performed under a lower temperature and for a shorter time. The temperature was raised from 145° C. to 199° C. for 20 min, then for 14 min allowed to fluctuate between 199° C., 181° C. and 206° C. (with 4 min above 200° C.), cooled down to 130° C. for 9 min, and finally cooled down to ambient temperature.

The solid residue from the reactor was removed, washed with water, and dried at 105° C. Its dry weight was 24.1 g (down from the initial 34.0 g of dry matter). This indicates that 9.9 g. i.e., 29% of the initial sludge, or 42% of the initial cellulose content (23.8 g, estimated), was solubilized.

160 mL of liquid were recovered from the reaction system; it had a pH of 1.45 and a glucose concentration of 8.0 g/L. The total amount of glucose formed in 216 mL of solution (including water in the wet sludge) was 1.73 g. Stoichiometrically, 1.56 g of cellulose was converted to that amount of glucose, translating into a 6.6% yield of glucose relative to the initial cellulose.

EXAMPLE 8

The procedure of Example 7 was repeated, but with the difference that the reaction mixture was kept at a higher temperature and for a longer time (similar with those in Examples 5 and 6 for washed/salt-free sludge residue). The temperature was raised from 165° C. to 209° C. for 27 min, then for 17 min allowed to fluctuate between 209° C., 186° C. and 210° C. (with 14 min above 200° C.), and cooled down to ambient temperature.

The solid residue from the reactor was removed, washed with water, and dried at 105° C. Its dry weight was 13.4 g (down from the initial 34.0 g of dry matter). This indicates that 20.6 g, i.e., 61% of the initial sludge, or 87% of the initial cellulose content (23.8 g, estimated), was solubilized.

164 mL of liquid were recovered from the reaction system; it had a pH 1.39 and a glucose concentration of 7.6 g/L. The total amount of glucose formed in 216 mL of solution (including water in the wet sludge) was 1.64 g. Stoichiometrically, 1.48 g of cellulose was converted to that amount of glucose, translating into a 6.2% yield of glucose relative to the initial cellulose.

It is apparent from Examples 5 through 8 that the presence of salt (largely calcium chloride) in sludge residues accelerates both the acid hydrolysis of cellulose and degradation of the formed glucose.

EXAMPLE 9

The procedure of Example 7 was repeated, but with the difference that the sludge was treated with 2% sulfuric acid (w/v) under a lower temperature. The temperature was raised from 144° C. to 183° C. for 17 min, then for 23 min allowed to fluctuate between 183° C., 174° C. and 199° C., cooled down to 185° C. for 15 min, and finally cooled down to ambient temperature.

The solid residue from the reactor was removed, washed with water, and dried at 105° C. Its dry weight was 13.3 g (down from the initial 34.0 g of dry matter). This indicates that 20.7 g, i.e., 61% of the initial sludge. or 87% of the initial cellulose content (23.8 g, estimated), was solubilized.

170 mL of liquid were recovered from the reaction system; it had a pH of 1.76 and a glucose concentration of 4.4 g/L. The total amount of glucose formed in 216 mL of solution (including water in the wet sludge) was 0.95 g. Stoichiometrically, 0.86 g of cellulose was converted to that amount of glucose, translating into a 3.6% yield of glucose relative to the initial cellulose.

EXAMPLE 10

The procedure of Example 5 was repeated, but with a different mixed office sludge, decalcified as described in Example 3. The salt-containing sludge was dried and re-wetted. It had a moisture content of 48%, an ash content of 46% (per dry weight), and a cellulose content of 28% (per dry weight).

50 g of this sludge residue were mixed with 200 mL of 1% sulfuric acid (w/v) and placed into an autoclave as described above. The temperature was raised from 143° C. (19 psi) to 190° C. (42 psi) for 7 min, cooled to 157° C. for 6 min, increased to 202° C. (218 psi) for 12 min, cooled to 166° C.(92 psi) for 3 min and finally cooled down to ambient temperature.

The solid residue from the reactor was removed, washed with water, and dried at 105° C. Its dry weight was 21.9 g (down from the initial 26.0 g of dry matter). This indicates that 4.1 g, i.e., 16% of the initial sludge, or 23% of the initial cellulose content (18.2 g, estimated), was solubilized.

180 mL of liquid were recovered from the reaction system; it had a pH of 1.4 and a glucose concentration of 6.2 g/L. The total amount of glucose formed in 224 mL solution (including water in the wet sludge) was 1.39 g. Stoichiometrically, 1.25 g of cellulose was converted to that amount of glucose, representing a 9.6% yield of glucose relative to the initial cellulose (estimated).

EXAMPLE 11

The procedure of Example 5 was repeated, but with a different mixed office sludge, decalcified as described in Example 4. The salt-containing sludge had a moisture content of 62%.

50 g of this sludge residue were mixed with 150 mL of 1% sulfuric acid (w/v) and placed into an autoclave as described above. The temperature was raised from 154° C. to 217° C. for 20 min, cooled to 163° C. for 15 min (16 min above 200° C.) and finally cooled down to ambient temperature.

The solid residue from the reactor was removed, washed with water, and dried at 105° C. Its dry weight was 14.3 g (down from the initial 19.0 g of dry matter). This indicates that 4.7 g, that is 25% of the initial sludge, or 49% of the initial cellulose content (9.5 g, estimated), was solubilized.

150 mL of liquid were recovered from the reaction system; it had a pH of 1.0 and a glucose concentration of 3.9 g/L. The total amount of glucose formed in 181 mL solution (including water in the wet sludge) was 0.706 g. Stoichiometrically, 0.64 g of cellulose was converted to that amount of glucose, representing a 6.7% yield of glucose relative to the initial cellulose.

EXAMPLE 12

The procedure of Example 11 was repeated, but using 100 mL of 1% sulfuric acid. The temperature was raised from 90° C. to 222° C. for 36 min, cooled to 176° C. for 6 min (22 min above 200° C.) and finally cooled down to ambient temperature.

95 mL of liquid were recovered from the reaction system, pH 1.24, glucose concentration was 4.7 g/L. The total amount of glucose formed in 131 mL solution (including water in the wet sludge) was 0.616 g. Stoichiometrically, 0.55 g of cellulose was converted to that amount of glucose, that is 5.8% yield of glucose in relation to the initial cellulose.

EXAMPLE 13

The same decalcified mixed office sludge residue as in Example 10 was used, but it was treated with 15% (w/w of dry solids), or 12.3% (w/v of the initial amount of liquid in the reaction mixture, before saturated steam was introduced) sulfuric acid in a 1-L steam explosion apparatus operated in a batch mode at a saturated steam pressure of 391 psi at 230° C. The mixture contained 100 g of the sludge residue (with a 50% moisture content) and 7.5 g of 96% sulfuric acid (corresponding to 7.2 g of pure acid, or, given the total liquid volume of 54 mL, a concentration of 133.3 g/L of pure acid (12.3% w/v)). The mixture was placed into an autoclave chamber, treated with said saturated steam for 1 min, and cooled instantly by discharging it into a receiver under the atmospheric pressure. The final volume of the hydrolyzate (including condensed steam) was 163 mL, and the pure acid concentration in the final mixture was 44.17 g/L, or 4.3% acid w/v.

The solid residue was separated from the hydrolyzate by filtration, washed with water, and dried at 105° C. Its dry weight was 28.17 g. This indicates that 21.83 g, that is 44% of the initial sludge amount (50 g) or 81% of the total organic component in the initial sludge (27 g), or 156% of the initial cellulose content (14 g) was solubilized and gasified, and otherwise lost in the process.

163 mL of the hydrolyzate, mostly steam condensate, were collected after filtration of the solid residue after the reaction. The concentration of glucose in the hydrolyzate was 7.5 g/L, and that of other soluble materials was 28 g/L. The total amount of glucose contained in 163 mL was 1.22 g, plus 0.49 g of glucose was collected from wash waters (476 mL, 1.03 g/L), for a total of 1.71 g of glucose. Stoichiometrically, 1.54 g of cellulose was converted to that amount of glucose (from the initial 50 g of dry matter containing 14 g of cellulose. This represents an 11% yield of glucose (relative to the initial cellulose).

The total amount of recovered materials (solid residue, glucose, and other soluble materials) was 36.9 g. 13.1 g (i.e., 26% of the initial material (dry weight) or 48.5% of the initial organic component of the sludge) were unaccounted for, and were apparently gasified or otherwise lost in the process.

The total amount of soluble material found in the hydrolyzate (including wash waters) was 8.74 g, 7.03 g of which was other than glucose. Thus, 20% of all solubilized matter in the hydrolyzate was glucose.

COMPARATIVE EXAMPLES 14 THROUGH 25

These Examples describe dilute sulfuric acid hydrolysis of cellulose components in virgin sulphite fine paper sludge (Examples 14 through 19) and unbleached kraft OCC (old corrugated containers) sludge (Examples 20 through 25). These sludge materials contained little if any calcium carbonate, and Examples 14–25 are provided for comparative purposes. The initial dried virgin sulphite fine paper sludge had a moisture content of 6.8%, an ash content of 4.4%, and an elemental calcium content of 1.06%. The initial unbleached kraft OCC sludge had a moisture content of 63%, an ash content of 12.5% (per dry weight), a cellulose content of 78% (per dry weight), and an elemental calcium content of 0.6% (per dry weight).

EXAMPLE 14

The acid treatment was performed as follows. 50 g of the initial dried virgin sulphite fine paper sludge were mixed with 200 mL of 1% sulfuric acid (w/v) and placed into an autoclave (Zipperclave, Autoclave Engineers, Erie, Pa.). The temperature was raised from 88° C. (2 psi) to 194° C. (91 psi) for 25 min, then kept for 12 min between 194° C. and 201° C. (145 psi) (5 min above 200° C.), cooled down to 174° C. (113 psi) for 18 min, and finally cooled down to ambient temperature.

The solid residue from the reactor was removed, washed with water, and dried at 105° C. Its dry weight was 25 g (down from the initial 46.6 g of dry matter). This indicates that 21.6 g, i.e., 46% of the initial sludge, or 66% of the initial cellulose content (32.6 g, estimated), was solubilized.

100 mL of liquid were recovered from the reaction system; the liquid had a pH of 1.95 and a glucose concentration of 49.7 g/L. The total amount of glucose formed in 200 mL of solution was 9.94 g. Stoichiometrically, 8.95 g of cellulose were converted to that amount of glucose, representing a 27% yield of glucose in relation to the initial cellulose.

EXAMPLE 15

The procedure of Example 14 was repeated, but with the difference that the reaction mixture was kept at a lower temperature and for a longer time period. The temperature was raised from 123° C. (6 psi) to 195° C. (42 psi) for 19 min, then for 35 min allowed to fluctuate between 195° C., 188° C. and 200° C. (161 psi was the highest pressure reached), cooled down to 98° C. (5 psi) for 18 min, and finally cooled down to ambient temperature.

The weight of the solid residue removed from the reactor, following washing with water and drying at 105° C., was 17.1 g. This indicates that 29.5 g, i.e., 63% of the initial sludge, or 90% of the initial cellulose content (estimated), was solubilized.

50 mL of liquid were recovered from the reaction system; the liquid had a pH of 1.65 and a glucose concentration of 34.9 g/L. The total amount of glucose formed in 200 mL of solution was 6.98 g. Stoichiometrically, 6.29 g of cellulose was converted to that amount of glucose translating into a 19% yield of glucose relative to the initial cellulose (estimated).

EXAMPLE 16

The procedure of Example 15 was repeated, but with the difference that the reaction mixture was kept at a still lower temperature. The temperature was raised from 135° C. to 186° C. for 50 min, then for 37 min allowed to fluctuate between 186° C., 178° C. and 186° C., cooled down to 121° C. for 24 min, and finally cooled down ambient temperature.

The weight of the solid residue removed from the reactor, following washing with water and drying at 105° C., was 38.4 g. This indicates that 8.2 g, i.e., 18% of the initial sludge, or 25% of the initial cellulose content (estimated), was solubilized.

110 mL of liquid were recovered from the reaction system; the liquid had a pH of 1.45 and a glucose concentration of 28.6 g/L. The total amount of glucose formed in 200 mL of solution was 5.72 g. Stoichiometrically, 5.15 g of cellulose were converted to that amount of glucose, translating into a 16% yield of glucose relative to the initial cellulose (estimated).

EXAMPLE 17

The procedure of Example 14 was repeated, but under a different temperature regime. The temperature was raised from 151° C. (17 psi) to 201° C. (38 psi) for 9 min, then kept for 23 min between 201° C., 179° C. and 196° C. (38 to 160 psi down to 156° C. (68 psi) for 14 min, and finally cooled down to ambient temperature.

150 mL of liquid were recovered from the reaction system; the liquid had a pH of 1.02 and a glucose concentration of 40.9 g/L. The total amount of glucose formed in 200 mL of solution was 8.18 g. Stoichiometrically, 7.37 g of cellulose were converted to that amount of glucose translating into a 23% yield of glucose relative to the initial cellulose (estimated).

EXAMPLE 18

The procedure of Example 14 was repeated, but with the difference that the sludge was treated with 2% sulfuric acid (w/v) under lower temperatures and lower pressures. The temperature was raised from 125° C. (5 psi) to 182° C. (43 psi) for 35 min, then for 28 min allowed to fluctuate between 182° C., 161° C., 187° C. and 178° C. (100 psi was the highest pressure reached), and cooled down to ambient temperature for 22 min.

The weight of the solid residue removed from the reactor, following washing with water and drying at 105° C., was 28.3 g. This indicates that 18.3 g, i.e., 39% of the initial sludge, or 56% of the initial cellulose content (estimated), was solubilized.

76 mL of liquid were recovered from the reaction system; the liquid had a pH of 1.2 and a glucose concentration of 24.5 g/L. The total amount of glucose formed in 200 mL of solution was 4.9 g. Stoichiometrically, 4.41 g of cellulose was converted to that amount of glucose, translating into a 14% yield of glucose relative to the initial cellulose (estimated).

EXAMPLE 19

The procedure of Example 14 was repeated, but with the difference that the sludge was treated with 0.5% sulfuric acid (w/v) under higher temperature and pressure but for a shorter time period. The temperature was raised from 124° C. (2 psi) to 202° C. (131 psi) for 35 min, then for 15 min allowed to fluctuate between 202° C., 194° C. and 211° C. (with 11 min above 200° C.; 170 psi was the highest pressure reached), cooled down to 126° C. (26 psi) for 13 min, and finally cooled down to ambient temperature.

The weight of the solid residue removed from the reactor, following washing with water and drying at 105° C., was 29.9 g. This indicates that 16.7 g, i.e., 36% of the initial sludge, or 51% of the initial cellulose content (estimated), was solubilized.

104 mL of liquid were recovered from the reaction system; the liquid had a pH of 1.82 and a glucose concentration of 10.5 g/L. The total amount of glucose formed in 200 mL of solution was 2.1 g. Stoichiometrically, 1.89 g of cellulose were converted to that amount of glucose, translating into a 5.8% yield of glucose relative to the initial cellulose (estimated).

EXAMPLE 20

The procedure of Example 14 was repeated, but with the difference that the sludge was unbleached kraft OCC (dried, with a moisture content of 5%), and that 20 g of this sludge was treated with 200 mL of 1% sulfuric acid. The temperature was raised from 151° C. to 197° C. for 18 min, then for 30 min allowed to fluctuate between 197° C., 175° C. and 199° C., cooled to 193° C. for 20 min and then to 125° C. for 42 min, and finally cooled down to ambient temperature.

The weight of the solid residue removed from the reactor, following washing with water and drying at 105° C., was 10.7 g (down from the initial 19.0 g of dry matter). This indicates that 8.3 g, i.e., 44% of the initial sludge. or 56% of the initial cellulose content (14.82 g), was solubilized.

150 mL of liquid were recovered from the reaction system; the liquid had a pH of 1.11 and a glucose concentration of 5.8 g/L. The total amount of glucose formed in 201 mL solution (including 1 mL of water content in the initial sludge) was 1.17 g. Stoichiometrically, 1.05 g of cellulose were converted to that amount of glucose, representing a 7.1% yield of glucose relative to the initial cellulose.

EXAMPLE 21

The procedure of Example 20 was repeated, but under a different temperature regime. The temperature was raised from 166° C. to 204° C. for 14 min, then for 21 min allowed to fluctuate between 204° C., 198° C. and 208° C. (with 24 min above 200° C.), cooled to 145° C. for 12 min, and finally cooled down to ambient temperature.

160 mL of liquid were recovered from the reaction system; the liquid had a pH of 1.4 and a glucose concentration of 6.2 g/L. The total amount of glucose formed in 201 mL of solution (including 1 mL of water content in the initial sludge) was 1.25 g. Stoichiometrically, 1.12 g of cellulose was converted to that amount of glucose, translating into a 7.6% yield of glucose relative to the initial cellulose.

EXAMPLE 22

The procedure of Example 20 was repeated, but with the difference that 50 g of the sludge (63% moisture) were treated with 2.5% sulfuric acid (w/v) and under higher temperature. The temperature was raised from 163° C. to 200° C. for 14 min, then for 21 min allowed to fluctuate between 200° C., 187° C. and 214° C. (with 10 min above 200° C.), cooled down to 124° C. for 17 min, and finally cooled down to ambient temperature.

The weight of the solid residue removed from the reactor, following washing with water and drying at 105° C., was 9.3 g. This indicates that 9.2 g, i.e., 50% of the initial sludge, or 64% of the initial cellulose, was solubilized.

200 mL of liquid were recovered from the reaction system; the liquid had a pH of 0.85 and a glucose concentration of 7.5 g/L. The total amount of glucose formed in 231.5 mL of solution was 1.74 g. Stoichiometrically, 1.56 g of cellulose were converted to that amount of glucose, translating into an 11% yield of glucose relative to the initial cellulose.

EXAMPLE 23

The same unbleached kraft OCC sludge as in Example 20 was used, but it was treated with 10% (w/w of dry solids) or 5.35% (w/v of the initial amount of liquid in the reaction mixture, before saturated steam was introduced) sulfuric acid in a 1-L steam explosion apparatus operated in a batch mode at saturated steam pressure 391 psi and temperature 230° C., as described in Example 13. 93 g of wet sludge, impregnated with sulfuric acid (the mixture contained 33.5 g of sludge per dry weight, 3.35 g of 96% sulfuric acid (i.e., 3.216 g of pure acid), and 56.2 g water) in a concentration of 55.21 g/L of pure acid (3.35% w/v), was placed into an autoclave chamber, and treated with said saturated steam for 6 min. The mixture was cooled instantly by discharging it into a receiver under atmospheric pressure. The final volume of the hydrolyzate (including condensed steam) was 414 mL, so the acid concentration in the final mixture was 7.77 g/L of pure acid, or 0.77% acid w/v.

The solid residue was separated from the hydrolyzate by filtration, washed with water, and dried at 105° C. Its dry weight was 17.2 g. This indicates that 16.3 g, i.e., 49% of the initial sludge, or 56% of the total organic component in the initial sludge (29.3 g), or 62% of the initial cellulose content (26.1 g) was solubilized and gasified, or otherwise lost in the process.

414 mL of the hydrolyzate, mostly steam condensate, was collected after filtration of the solid residue after the reaction. The pH of the hydrolyzate was 1.5, the glucose concentration was 6.3 g/L, and the concentration of other soluble materials was 15.9 g/L. The total amount of glucose contained in 414 mL was 2.61 g; in addition, 0.32 g of glucose was collected from wash waters (229 mL, 1.4 g/L), for a total of 2.94 g of glucose. Stoichiometrically, 2.65 g of cellulose were converted to that amount of glucose (from the initial 33.5 g of dry matter (or from 26.1 g of cellulose)), translating into a 10% yield of glucose relative to the initial cellulose.

The total amount of recovered materials (solid residue, glucose, and other soluble materials) was 27.71 g. 5.79 g, i.e., 17.3% of the initial material (dry weight) or 19.8% of the initial organic component of the sludge, was unaccounted for, and was apparently gasified or otherwise lost in the process.

The total amount of soluble material found in the hydrolyzate (including wash waters) was 10.51 g, 7.57 g of which was not glucose. Thus, 28% of all solubilized matter in the hydrolyzate was glucose.

EXAMPLE 24

The procedure of Example 23 was repeated, but with the difference that the sulfuric acid concentration was 15% (w/w of dry matter) or 12.3% (w/v of the initial amount of liquid in the reaction mixture, before saturated steam was introduced), and 100 g of the sludge (with a moisture content of 50%) were treated in the steam reactor. The mixture contained 50 g of sludge per dry weight and 7.5 g of 96% sulfuric acid (itself containing 7.2 g of pure acid), i.e., 54 mL of liquid having a concentration of 133.3 g/L of pure acid (12.3% w/v). The mixture was placed into an autoclave chamber, and treated with said saturated steam for 4 min. The final volume of hydrolyzate (including condensed steam) was 487 mL; the concentration of pure acid in the final mixture was 14.78 g/L, or 1.46% acid w/v.

The solid residue was separated from the hydrolyzate by filtration, washed with water, and dried at 105° C. Its dry weight was 16.5 g. This indicates that 33.5 g, i.e., 67% of the initial sludge amount, or 77% of the total organic component in the initial sludge (43.75 g), or 86% of the initial cellulose content (39 g) was solubilized and gasified or otherwise lost in the process.

487 mL of the hydrolyzate, mostly steam condensate, was collected after filtration of the solid residue after the reaction. pH of the hydrolyzate was 1.1, glucose concentration 7.4 g/L, other soluble materials 24.3 g/L. The total amount of glucose contained in 487 mL was 3.63 g, plus 0.37 g of glucose was collected from wash waters (467 mL, 0.79 g/L), total 4.00 g of glucose. Stoichiometrically, 3.6 g of cellulose were converted to that amount of glucose—from the initial 50 g of dry matter (or from 39 g of cellulose), that is 9.2% yield of glucose in relation to the initial cellulose.

Total amount of recovered materials (solid residue, glucose, and other soluble materials) was 33.34 g. 16.66 g, that was 33% of the initial material (dry weight) or 38% of the initial organic component of the sludge, was unaccounted for, and was apparently gasified and lost otherwise in the process.

The total amount of soluble material found in the hydrolyzate (including wash waters) was 16.84 g, 12.84 g of which was not glucose. Thus, 24% of all solubilized matter in the hydrolyzate was glucose.

EXAMPLE 25

The procedure of Example 24 was repeated, but with the difference that the reaction mixture was treated with saturated steam for 1 min and, as a result, less condensed steam formed. The final volume of the hydrolyzate (including condensed steam) was 192 mL, so the concentration of pure acid in the final mixture was 37.5 g/L, or 3.66% acid w/v.

The solid residue was separated from the hydrolyzate by filtration, washed with water, and dried at 105° C. Its dry weight was 19.46 g. This indicates that 30.54 g, i.e., 61% of the initial sludge amount, or 70% of the total organic component in the initial sludge (43.75 g), or 78% of the initial cellulose content (39 g) was solubilized and gasified or otherwise lost in the process.

192 mL of the hydrolyzate, mostly steam condensate, was collected after filtration of the solid residue after the reaction. The glucose concentration in the hydrolyzate was 17.4 g/L, and the concentration of other soluble materials 43.4 g/L. The total amount of glucose contained in 192 mL was 3.33 g; in addition, 0.28 g of glucose was collected from wash waters (469 mL. 0.6 g/L), for a total of 3.61 g of glucose. Stoichiometrically, 3.25 g of cellulose were converted to that amount of glucose (from the initial 50 g of dry matter (or from 39 g of cellulose)), translating into an 8.3% yield of glucose relative to the initial cellulose.

The total amount of recovered materials (solid residue, glucose, and other soluble materials) was 32.97 g. 17.03 g, i.e., 34% of the initial material (dry weight) or 39% of the initial organic component of the sludge, were unaccounted for, and were apparently gasified or otherwise lost in the process.

The total amount of soluble material found in the hydrolyzate (including wash waters) was 13.51 g, 9.90 g of which were not glucose. Thus, 27% of all solubilized matter in the hydrolyzate was glucose.

TABLE 1

Concentrations and yields of glucose formed by dilute sulfuric acid hydrolysis of the cellulose component of papermaking sludge. Concentration of the acid corresponds to that added to the sludge.

| Example | Acid (w/v), % | Glucose, g/L | Glucose yield, % |
|---|---|---|---|
| 5 | 1 | 10.7 | 7.4 |
| 6 | 1 | 8.4 | 9.1 |
| 7 | 1 | 8.0 | 6.6 |
| 8 | 1 | 7.6 | 6.2 |
| 9 | 2 | 4.4 | 3.6 |
| 10 | 1 | 6.2 | 9.6 |
| 11 | 1 | 3.9 | 6.7 |
| 12 | 1 | 4.7 | 5.8 |
| 13 | 12.3→4.3 | 7.5 | 11 |
| 14 | 1 | 49.7 | 27 |
| 15 | 1 | 34.9 | 19 |
| 16 | 1 | 28.6 | 16 |
| 17 | 1 | 40.9 | 23 |
| 18 | 2 | 24.5 | 14 |
| 19 | 0.5 | 10.5 | 5.8 |
| 20 | 1 | 5.8 | 7.1 |
| 21 | 1 | 6.2 | 7.6 |
| 22 | 2.5 | 7.5 | 11 |
| 23 | 5.4→0.8 | 6.3 | 10 |
| 24 | 12.3→1.5 | 7.4 | 9.2 |
| 25 | 12.3→3.7 | 17.4 | 8.3 |

F. Strong Acid Cellulose Hydrolysis

EXAMPLE 26

This example describes concentrated (72% in the first treatment/pretreatment and 48% in the second treatment) sulfuric acid hydrolysis of the cellulose component in mixed office waste papermaking sludge, decalcified as described in Example 1. The sludge residue was washed (to remove salts, mainly calcium chloride) and air dried, and had a moisture content of 39%, an ash content of 21.2%, an elemental calcium content of 0.2% (per dry weight), and contained 55% cellulose (per dry weight, estimated).

The acid treatment was performed as follows. 50 g of the sludge residue was mixed with 75 mL of 83.5% sulfuric acid w/v (830 mL of 96.4% acid was diluted to 1 L with water) for 10 min at ambient temperature (the temperature of the mixture immediately increased because of moisture contact with the concentrated acid), then 75 mL of water were added and the mixture (169.5 mL of diluted acid total, including water content in the initial sludge residue) was heated at 70° C. for 1 hr and finally cooled down to ambient temperature. The glucose concentration in the separated hydrolyzate was 56 g/L.

Glucose concentrations measured during the course of the reaction in parallel procedures carried out immediately after dilution of the mixture but before the heating step (from the initial 72% of sulfuric acid, including water content in the initial sludge residue, to 47.6%), and after 30 min, 45 min, 60 min, 90 min, and 120 min following the heating step were 26 g/L, 53 g/L, 56 g/L, 56 g/L, 52 g/L, and 33 g/L, respectively.

The total amount of glucose formed in 169.5 mL solution was 9.49 g. Stoichiometrically, 8.55 g of cellulose was converted to that amount of glucose, representing a 51% yield of glucose relative to the initial cellulose (16.78 g, estimated).

EXAMPLE 27

The procedure of Example 26 was repeated, but with the difference that the sludge was pretreated with the concentrated acid for 18 min at the noted conditions, then 70 mL of water were added, and the mixture (164.5 mL of diluted acid total, including water content in the initial sludge residue) was heated at 70° C. for 90 min and finally cooled down to ambient temperature. The glucose concentration in the separated hydrolyzate was 56 g/L.

Glucose concentrations measured during the course of the reaction in parallel procedures carried out immediately after dilution of the mixture (from the initial 72% of sulfuric acid, including water content in the initial sludge residue, to 48.3%), and after 30 min, 60 min, 90 min, 120 min, and 135 min following the heating step were 20 g/L, 38 g/L, 47 g/L, 56 g/L, 50 g/L, and 40 g/L, respectively.

The total amount of glucose formed in 164.5 mL solution was 9.21 g. Stoichiometrically, 8.30 g of cellulose were converted to that amount of glucose, representing a 49% yield of glucose relative to the initial cellulose (16.78 g, estimated).

EXAMPLES 28 AND 29

The procedure of Example 26 was repeated, but with the difference that the sludge residue had a higher moisture content (64%), and the glucose concentration in the reaction mixture was measured in the course of acid hydrolysis.

EXAMPLE 28

50 g of the sludge residue were mixed with 75 mL of 83.5% sulfuric acid w/v (prepared as described in Example 26) for 10 min, then 75 mL of water was added and the mixture (182 mL of diluted acid total, including water content in the initial sludge residue) was heated at 70° C. for 1 hr and finally cooled down to ambient temperature. The glucose concentration in the separated hydrolyzate was 19 g/L.

Glucose concentrations measured during the course of the reaction immediately after dilution of the mixture but before the heating step (from the initial 66% of sulfuric acid, including water content in the initial sludge residue, to 45%), and after 15 min, 30 min, 45 min and 60 min following the heating step were 25 g/L, 27 g/L, 26 g/L, 21 g/L, and 19 g/L, respectively.

The total amount of glucose formed in 182 mL solution was 3.46 g. Stoichiometrically 3.12 g of cellulose were converted to that amount of glucose, representing 32% yield of glucose relative to the initial cellulose (9.9 g, estimated).

EXAMPLE 29

50 g of the sludge residue were mixed with 75 mL of 83.5% sulfuric acid w/v for 18 min, then 75 mL of water were added and the mixture (182 mL of diluted acid total, including water content in the initial sludge residue) was heated at 70° C. for 1:45 hr. Glucose concentrations measured during the course of the reaction, immediately after dilution of the mixture before the heating (from the initial 66% of sulfuric acid, including water content in the initial sludge residue, to 45%), and after 15 min, 30 min, 45 min, 60 min, 90 min, and 105 min following the heating step were 17 g/L, 21 g/L, 25 g/L, 26 g/L, 32 g/L, 26 g/L, and 26 g/L, respectively.

The total amount of glucose formed in 182 mL solution after 1 hr heating was 5.82 g. Stoichiometrically, 5.25 g of cellulose were converted to that amount of glucose, translating into a 53% yield of glucose relative to the initial cellulose (9.9 g, estimated).

EXAMPLE 30

The procedure of Example 26 was repeated, but with the difference that unwashed (salt-containing) air-dried sludge residue, with moisture content 30%, was used.

50 g of the sludge residue were mixed with 75 mL of 83.5% sulfuric acid w/v (prepared as described in Example 26) for 17 min, then 75 mL of water were added and the mixture (165 mL of diluted acid total, including water content in the initial sludge residue) was heated at 70° C. for 4 hrs. Glucose concentrations measured during the course of the reaction, immediately after dilution of the mixture before the heating step (from the initial 74% of sulfuric acid, including water content in the initial sludge residue, to 49%), and after 30 min, 45 min, 60 min, 1:30 hrs, 2 hrs, and 4 hrs following the heating step were 9.8 g/L, 23 g/L, 23 g/L, 28 g/L, 31 g/L, 32 g/L, and 9.1 g/L, respectively.

The total amount of glucose formed in 165 mL solution after 2 hr heating was 5.28 g. Stoichiometrically, 4.76 g of cellulose were converted to that amount of glucose, translating into a 25% yield of glucose relative to the initial cellulose (19.3 g, estimated).

EXAMPLE 31

The procedure of Example 30 was repeated, but with the difference that the unwashed (salt-containing) sludge residue was completely dried before the acid treatment, and a larger amount of acid was used for the hydrolysis.

50 g of the sludge residue were mixed with 100 mL of 83.5% sulfuric acid w/v (prepared as described in Example 26) for 18 min, then 100 mL of water were added and the mixture (200 mL of diluted acid total) was heated at 70° C. for 90 min. Glucose concentrations measured during the course of the reaction, immediately after dilution of the mixture but before the heating step (from the initial 83.5% of sulfuric acid to 52%), and after 30 min, 60 min, and 90 min following the heating step were 3.9 g/L, 41 g/L, 35 g/L, and 34 g/L, respectively.

The total amount of glucose formed in 200 mL solution after 30 min of heating was 8.2 g. Stoichiometrically, 7.39 g of cellulose were converted to that amount of glucose, translating into a 27% yield of glucose relative to the initial cellulose (27.5 g, estimated).

COMPARATIVE EXAMPLES 32 AND 33

These examples describe the first (pretreatment) step of acid hydrolysis of the cellulose component in the decalcified mixed office waste sludge residues described in Examples 28–29 (salt-free sludge) and Example 30 (salt-containing sludge).

EXAMPLE 32

50 g of wet washed (salt-free) sludge residue (moisture content 64%) was mixed at room temperature with 75 mL of 83.5% (w/v) sulfuric acid for a period of time from 1 min to 15 min, and the glucose concentration was measured during the course of reaction. After 1 min, 2 min, 3 min, 5 min, 8 min, 10 min, and 15 min, the glucose concentration was 25 g/L, 29 g/L, 32 g/L, 34.5 g/L, 33 g/L, 32 g/L, and 30 g/L, respectively.

EXAMPLE 33

50 g of wet unwashed (salt-containing) sludge residue (moisture content 30%) was mixed at room temperature with 75 mL of 83.5% (w/v) sulfuric acid for a period of time from 1 min to 18 min, and the glucose concentration was measured during the course of reaction. After 1 min, 2 min, 3 min, 5 min, 8 min, 10 min, and 18 min, the glucose concentration was 15 g/L, 22 g/L, 29 g/L, 33 g/L, 27 g/L, 26.5 g/L, and 25 g/L, respectively. Thus, despite a higher— almost 2 times—sludge/cellulose concentration in this case compared with that of Example 32, the yield of glucose was lower.

It is apparent from these experiments that the presence of salt (largely calcium chloride) in sludge residues decreases the concentration of glucose formed at the first (pretreatment) step of the acid hydrolysis of cellulose component in sludge.

EXAMPLE 34

The procedure of Example 30 was repeated, but with the difference that the unwashed (salt-containing) air-dried sludge residue (moisture content 33%) was treated with more concentrated acid in the first step and with a less concentrated acid in the second step, and the reaction mixture was cooled (on ice) during the first (pretreatment) step of acid hydrolysis.

50 g of the sludge residue were mixed with 50 mL of 96% sulfuric acid (w/v) for 15 min on ice (because of dilution with water, the acid concentration in the mixture should have decreased to 78%), then 148 mL of water were added, and the mixture (214.5 mL of 33%-acid total, including water content in the initial sludge residue) was boiled for 40 min and cooled to ambient temperature. The glucose concentration in the hydrolyzate separated from the remaining solids was 53 g/L.

The total amount of glucose formed in 214.5 mL solution was 11.4 g. Stoichiometrically, 10.2 g of cellulose were converted to that amount of glucose, translating into a 55% yield of glucose relative to the initial cellulose (18.4 g, estimated).

The solid residue from the reactor was removed, washed with water, and dried at 105° C. Its dry weight was 15.7 g (down from the initial 33.5 g of dry matter). This indicates that 17.8 g, i.e., 53% of the initial sludge, or 97% of the initial cellulose content (estimated), was solubilized.

EXAMPLE 35

The procedure of Example 34 was repeated, but with the difference that the unwashed (salt-containing) sludge residue was dried before treatment with concentrated (96%) sulfuric acid.

50 g of the dried sludge residue were mixed with 50 mL of 96% sulfuric acid (w/v) for 15 min on ice, then 190 mL of water were added, and the mixture (containing 240 mL of 30% of acid) was boiled for 40 min and cooled to ambient temperature. The glucose concentration in the hydrolyzate separated from the remaining solids was 47 g/L.

The total amount of glucose formed in 240 mL solution was 11.3 g. Stoichiometrically, 10.2 g of cellulose were converted to that amount of glucose, translating into a 37% yield of glucose relative to the initial cellulose (27.5 g, estimated).

The solid residue from the reactor was removed, washed with water, and dried at 105° C. Its dry weight was 9.1 g (down from the initial 50 g of dry matter). This indicates that 40.9 g, i.e., 82% of the initial sludge, or practically all of the initial organic content, was solubilized.

EXAMPLE 36

The procedure of Example 34 was repeated, but with the difference that unwashed (salt-containing) sludge residue was obtained as described in Example 2. The material had a moisture content of 63%.

50 g of the dried sludge residue were mixed with 50 mL of 96% sulfuric acid (w/v) for 15 min on ice (because of dilution with water, the acid concentration in the mixture should have decreased to 68%), then 160 mL of water were added, and the mixture (containing 241.5 me of 30% of acid) was boiled for 40 min and cooled to ambient temperature. The glucose concentration in the hydrolyzate separated from the remaining solids was 32 g/L.

The total amount of glucose formed in 241.5 mL solution was 7.73 g. Stoichiometrically, 6.96 g of cellulose were converted to that amount of glucose, translating into a 68% yield of glucose relative to the initial cellulose (10.18 g, estimated).

The solid residue from the reactor was removed, washed with water, and dried at 105° C. Its dry weight was 8.8 g (down from the initial 18.5 g of dry matter). This indicates that 9.7 g, i.e., 52% of the initial sludge, or 95% of the initial cellulose content, was solubilized.

EXAMPLE 37

The procedure of Example 36 was repeated, but with a different mixed office sludge, decalcified as described in Example 3; the salt-containing sludge was dried and rewetted, and had a moisture content of 48% and a cellulose content of 28%; 150 mL of water were added at the second step of the acid hydrolysis.

50 g of the wet sludge residue were mixed with 50 mL of 96% sulfuric acid (w/v) for 15 min on ice (because of dilution with water, the acid concentration in the mixture should have decreased to 73%), then 150 mL of water were added, and the mixture (containing 224 mL of 32% of acid) was boiled for 40 min and cooled to ambient temperature. The glucose concentration in the hydrolyzate separated from the remaining solids was 25 g/L.

The total amount of glucose formed in 224 mL solution was 5.6 g. Stoichiometrically, 5.05 g of cellulose were converted to that amount of glucose, translating into a 69% yield of glucose relative to the initial cellulose (7.28 g).

The solid residue from the reactor was removed, washed with water, and dried at 105° C. Its dry weight was 17.4 g (down from the initial 26.0 g of dry matter). This indicates that 8.6 g, i.e., 33% of the initial sludge, or 66% of the initial cellulose content, was solubilized.

EXAMPLE 38

This Example describes concentrated acid hydrolysis of the cellulose component of a mixed office sludge, decalcified as described in Example 4; the salt-containing sludge was dried to a moisture content of 4%, an ash content of 45.6% (silica, 21%; other inorganic materials, 24.6%), a cellulose content of 28.1%, and a hemicellulose content of 3.7%.

500 g of the sludge residue were mixed with 276 g (169 mL) of 72% sulfuric acid (w/w) for 40 min (the acid concentration in the liquid fraction of the mixture was 67% w/v), then 143 g of water were added, and the mixture (containing 332 mL of 45% w/v of acid) was heated at 100° C. for 50 min and then cooled to ambient temperature. The glucose concentration in the total slurry was 10.1% w/w; the amount of xylose was negligible, less than 0.1%. The separated hydrolyzate contained essentially pure glucose, in a concentration of 18%.

The total amount of glucose formed in 919 g of slurry was 92.8 g. Stoichiometrically, 83.6 g of cellulose were converted to that amount of glucose, translating into a 62% yield of glucose relative to the initial cellulose (135 g).

COMPARATIVE EXAMPLES 39 THROUGH 46

These Examples describe concentrated sulfuric acid hydrolysis of cellulose components in virgin sulphite fine paper sludge (Examples 39–42 and 45–46) and unbleached kraft OCC (old corrugated containers) sludge (Examples 43–44 and 47). These sludge materials contained little if any calcium carbonate, and the Examples are provided for comparative purposes. The sludge materials themselves are described in Comparative Examples 20 through 25.

EXAMPLE 39

50 g of the initial dried virgin sulphite fine paper sludge were mixed with 50 mL of 96% sulfuric acid (w/v) for 15 min on ice, then 191 mL of water were added, and the mixture (containing 244 mL of 30% of acid) was heated at 100° C. for 40 min and cooled to ambient temperature. The glucose concentration in the hydrolyzate separated from the remaining solids was 77 g/L.

The total amount of glucose formed in 244 mL solution was 18.8 g. Stoichiometrically, 16.9 g of cellulose were converted to that amount of glucose, translating into a 52% yield of glucose relative to the initial cellulose (32.6 g, estimated).

EXAMPLE 40

The procedure of Example 39 was repeated, but with the difference that at 30% acid treatment (in the second step of the acid hydrolysis) the mixture was heated at 80° C. for 60 min. The glucose concentration in the hydrolyzate separated from the remaining solids was 75 g/L. The total amount of glucose formed in 244 mL solution was 18.3 g. Stoichiometrically, 16.5 g of cellulose were converted to that amount of glucose, translating into a 51% yield of glucose relative to the initial cellulose (32.6 g, estimated).

EXAMPLE 41

The procedure of Example 40 was repeated, but with the difference that at 30% acid treatment (in the second step of the acid hydrolysis) the mixture was heated at 80° C. for 40 min. The glucose concentration in the hydrolyzate separated from the remaining solids was 64 g/L. The total amount of glucose formed in 244 mL solution was 15.6 g. Stoichiometrically, 14.1 g of cellulose were converted to that amount of glucose, translating into a 43% yield of glucose relative to the initial cellulose (32.6 g, estimated).

EXAMPLE 42

The procedure of Example 41 was repeated, but with the difference that 80% sulfuric acid was added to the sludge material during the first (pretreatment) step of the acid hydrolysis. 50 g of the initial dried virgin sulphite fine paper sludge were mixed with 50 mL of 80% sulfuric acid (w/v) for 15 min on ice, then 139 mL of water were added, and the mixture (containing 192 mL of 30% of acid) was heated for 40 min at 80° C. and then cooled to ambient temperature. The glucose concentration in the hydrolyzate separated from the remaining solids was 59 g/L.

The total amount of glucose formed in 192 mL solution was 11.3 g. Stoichiometrically, 10.2 g of cellulose were converted to that amount of glucose, translating into a 31% yield of glucose relative to the initial cellulose (32.6 g, estimated).

EXAMPLE 43

The procedure of Example 39 was repeated, but with the difference that 50 g of the dried unbleached kraft OCC sludge (moisture content 9.2%, cellulose content 46% per dry weight) were mixed with 50 mL of 96% sulfuric acid (w/v) for 15 min on ice, then 100 mL of water were added. The mixture (containing 155 mL of 43% acid) was heated at 100° C. for 40 min, and then cooled to ambient temperature. The glucose concentration in the hydrolyzate separated from the remaining solids was 55 g/L,.

The total amount of glucose formed in 155 mL solution was 8.5 g. Stoichiometrically, 7.7 g of cellulose were converted to that amount of glucose, translating into a 37% yield of glucose relative to the initial cellulose (20.9 g).

EXAMPLE 44

The procedure of Example 43 was repeated, but with the difference that 150 mL of water were added to the reaction mixture at the second step of the reaction, and the mixture (containing 205 mL of 34% acid) was heated for 40 min and cooled. The glucose concentration in the hydrolyzate separated from the remaining solids was 44 g/L.

The total amount of glucose formed in 205 mL solution was 9.02 g. Stoichiometrically, 8.1 g of cellulose were converted to that amount of glucose, translating into a 39% yield of glucose relative to the initial cellulose (20.9 g).

EXAMPLE 45

The procedure of Example 39 was repeated three consecutive times with the same sludge residue.

50 g of the sludge were mixed with 50 mL of 96% sulfuric acid (w/v) for 15 min on ice, then 241 mL of water were added. The mixture (containing 244 mL of 30% of acid) was heated at 100° C. for 40 min, and then cooled to ambient temperature. 200 mL of the hydrolyzate were recovered after separation from the remaining solids. The glucose concentration in the hydrolyzate after this first cycle of the hydrolysis was 88 g/L (corresponding to 59% of the theoretical glucose yield).

The solid residue from the reactor was washed with water and mixed again with 50 mL of 96% sulfuric acid for 15 min on ice. 241 mL of water were then added, and the mixture was heated at 100° C. again for 40 min and cooled to ambient temperature. 210 mL of the hydrolyzate were recovered. The glucose concentration in the hydrolyzate after this second cycle of the hydrolysis was 63 g/L.

The solid residue from the reactor was washed with water and mixed again with 50 mL of 96% sulfuric acid for 15 min on ice. 241 mL of water were added, and the mixture was then heated at 100° C. for 40 min. After cooling, 250 mL of the hydrolyzate were recovered. The glucose concentration in the hydrolyzate after this third cycle of the hydrolysis was 14 g/L.

The solid residue from the reactor (after three cycles of the acid hydrolysis) was washed with water and dried at 105° C. Its dry weight was 8.1 g (down from the initial 46.6 g of dry matter). This indicates that 38.5 g, i.e., 83% of the initial sludge, or practically all of the initial cellulose content, was solubilized.

EXAMPLE 46

The procedure of Example 45 was repeated, but with the difference that the all three hydrolysis cycles were performed using 80% sulfuric acid at the pretreatment step.

50 g of the sludge were mixed with 50 mL of 80% sulfuric acid (w/v) for 15 min on ice, then 189 mL of water were added. The mixture (containing 242 mL of 30% of acid) was heated at 100° C. for 40 min and cooled to ambient temperature. 160 mL of the hydrolyzate were recovered after separation from the remaining solids. The glucose concentration in the hydrolyzate after this first cycle of the hydrolysis was 45 g/L (corresponding to 30% of the theoretical glucose yield).

The solid residue from the reactor was washed with water and mixed again with 50 mL of 80% sulfuric acid for 15 min on ice. 189 mL of water were added, and the mixture was heated at 100° C. again for 40 min and cooled to ambient temperature. 250 mL of the hydrolyzate were recovered. The glucose concentration in the hydrolyzate after this second cycle of the hydrolysis was 19 g/L.

The solid residue from the reactor was washed with water and mixed again with 50 mL of 80% sulfuric acid for 15 min on ice. 189 mL of water were added, and the mixture was heated at 100° C. for 40 min. After cooling, 210 mL of the hydrolyzate were recovered. The glucose concentration in the hydrolyzate after this third cycle of the hydrolysis was 8.2 g/L.

The solid residue from the reactor (after three cycles of the acid hydrolysis) was washed with water and dried at 105° C. Its dry weight was 24.5 g (down from the initial 46.6 g of dry matter). This indicates that 22.1 g. i.e., 47% of the initial sludge, or 68% of the initial cellulose content, was solubilized.

TABLE 2

Concentrations and yields of glucose formed by strong sulfuric acid hydrolysis of the cellulose component of papermaking sludge. Concentrations of the acid correspond to those at two steps of the hydrolysis.

| Example | Acid (w/v), % | Glucose, g/L | Glucose yield, % |
|---|---|---|---|
| 26 | 72/47.6 | 56 | 51 |
| 27 | 72/48.3 | 56 | 49 |
| 28 | 66/45 | 27 | 32 |
| 29 | 66/45 | 32 | 53 |
| 30 | 74/49 | 32 | 25 |
| 31 | 83.5/52 | 41 | 27 |
| 34 | 78/33 | 53 | 55 |
| 35 | 96/30 | 47 | 37 |
| 36 | 68/30 | 32 | 68 |
| 37 | 73/32 | 25 | 69 |
| 38 | 67/45 | 180 | 62 |
| 39 | 96/30 | 77 | 52 |
| 40 | 96/30 | 75 | 51 |
| 41 | 96/30 | 64 | 43 |
| 42 | 80/30 | 59 | 31 |
| 43 | 96/43 | 55 | 37 |
| 44 | 96/34 | 44 | 39 |
| 45 | 96/30 | 88 | 59 |
| 45 (three cycles) | 96/30 | 88-63-14 | 100 |
| 46 | 80/30 | 45 | 30 |
| 46 (three cycles) | 80/30 | 45-19-8.2 | 68 |

The experiments described in this section showed that the cellulose component in decalcified papermaking sludge can be efficiently converted to glucose by treating the material with concentrated sulfuric acid. Moreover, the efficiency of the hydrolysis of the decalcified, high-ash sludge was close to that of low-ash virgin pulp: the glucose concentration in a hydrolyzate after just one cycle of the hydrolysis reached 56 g/L (representing a conversion efficiency of 40%) in the former case and 59–88 g/L (31–59% conversion) in the latter.

It will be apparent from the above that a new and unique process has been disclosed for production of glucose from papermaking sludge initially containing calcium carbonate (and thereby precluding using acids for hydrolysis of its cellulose component). The process results in two major product streams, i.e., a solution of calcium salt and a solution of glucose. The salts recovered from sludge are suitable for many uses, including preparation of reagent chemicals such as calcium chloride (or other calcium salts, if other acids are used at the decalcination step as disclosed in copending application Ser. No. 08/877,548; precipitation as salts, such as calcium carbonate; preparation of liquid and solid de-icers, such as calcium acetate (alone or in combination with known de-icing chemicals such as magnesium salts); preparation of sulfur-capturing sorbents based on calcium salts, etc. The glucose obtained from sludge is also suitable for many uses, including fermentation to many organic substances such as alcohols and organic acids; and preparation of liquid and solid de-icers, as mentioned above, thereby uniting both product streams of the inventive process. The invention process therefore provides new use for calcium-containing paper sludges that heretofore have primarily been burned or landfilled, creating environmental pressure. It will be clear from the present disclosure that both calcium salts and glucose, resulting from waste paper sludge in general, may be utilized for a wide variety of purposes.

Although this invention has been described in its preferred form and preferred practice with a certain degree of particularity, it is understood that the present disclosure of the preferred form and preferred practice has been made only by way of example and that numerous changes may be resorted to without departing from the spirit and the scope of the invention as hereinafter claimed.

What is claimed is:

1. A method of producing glucose from an aqueous mixture comprising papermaking sludge, the method comprising the steps of:

a. removing calcium carbonate from the sludge to produce a mixture substantially depleted of calcium and containing cellulose;

b. hydrolyzing cellulose in the calcium-depleted mixture with an acid; and c. recovering a liquid fraction comprising glucose.

2. The method of claim 1 wherein the sludge mixture comprises solid and liquid fractions, the calcium-removal step comprising:

a. combining the sludge mixture with an acid to solubilize calcium present in the sludge mixture;

b. incubating the sludge mixture; and c. separating the liquid fraction.

3. The method of claim 2 wherein the calcium-solubilizing acid is selected from the group consisting of hydrochloric acid, nitric acid, acetic acid, and phosphoric acid.

4. The method of claim 2 wherein the calcium-solubilizing acid has a concentration ranging from 0.1% to 55% by weight.

5. The method of claim 2 wherein the sludge mixture contains an amount of calcium carbonate, the calcium-solubilizing acid being present in a stoichiometric proportion ranging from 0.8 to 5.0 relative to the amount of calcium carbonate.

6. The method of claim 1 wherein the calcium-depleted mixture is predominantly solids, the acid-hydrolysis step introducing a liquid fraction, and further comprising the step of extracting glucose from the liquid fraction.

7. The method of claim 1 wherein the acid-hydrolysis step comprises combining the calcium-depleted mixture with sulfuric acid having a concentration ranging from 0.5% to 5%.

8. The method of claim 7 wherein the sludge mixture comprises solid and liquid fractions, the acid-hydrolysis step comprising:

a. heating the sludge mixture in a sealed chamber at a temperature ranging from 180° to 240° C.;

b. separating the liquid fraction; and c. recovering glucose from the liquid fraction.

9. The method of claim 8 wherein the calcium-depleted mixture is heated for a time ranging from 10 seconds to 40 minutes.

10. The method of claim 1 wherein the calcium-depleted mixture is predominantly solids, the acid-hydrolysis step comprising combining the calcium-depleted mixture with sulfuric acid having a concentration ranging from 0.5% to 30% of the solids.

11. The method of claim 1 wherein the acid-hydrolysis step comprises combining the calcium-depleted mixture with sulfuric acid having a concentration ranging from 50% to 98% w/w.

12. The method of claim 11 wherein the sludge mixture comprises solid and liquid fractions, the acid-hydrolysis step comprising:

a. agitating the sludge mixture under cooling conditions;

b. adding water to the sludge mixture;

c. incubating the sludge mixture under heating conditions;

d. separating a liquid fraction; and e. recovering glucose solution the liquid fraction.

13. The method of claim 12 wherein the mixture is agitated under cooling conditions for a time ranging from 5 min to 40 min.

14. The method of claim 12 wherein the water-adding step decreases the sulfuric-acid concentration to a diluted concentration ranging from 20% to 50% w/w.

15. The method of claim 12 wherein, during the incubation step, the sludge mixture is heated to a temperature ranging from 60° C. to 100° C.

16. The method of claim 12 wherein the glucose-recovery step comprises extraction with an acid-immisible solvent.

17. The method of claim 16 wherein the solvent is selected from the group consisting of long-chain alcohols, acetophenone and propionaldehyde.

18. The method of claim 1 wherein the calcium-depleted mixture is predominantly solids, the acid-hydrolysis step comprising combining the calcium-depleted mixture with an amount of sulfuric acid in a ratio, by weight, ranging from 1:0.7 to 1:7.0.

19. The method of claim 1 wherein the sludge is derived from at least one of (a) fine paper sludge, (b) coated paper sludge, (c) coated fine paper sludge, (d) recycled mixed office paper sludge, (e) recycled newsprint, (f) de-inked paper mill sludge, (g) old corrugated cardboards.

20. The method of claim 1 further comprising the steps of separating and fermenting the glucose.

21. A method of producing glucose from an aqueous mixture comprising papermaking sludge, the method comprising the steps of:

a. hydrolyzing cellulose in the mixture with an acid; and b. recovering a liquid fraction comprising glucose by extraction with propionaldehyde.

* * * * *